US006286240B1

(12) United States Patent
Collins

(10) Patent No.: US 6,286,240 B1
(45) Date of Patent: Sep. 11, 2001

(54) SAFETY DEVICE FOR FIREARMS

(76) Inventor: Kenneth Ray Collins, 19 Kinpert Dr. Box #6, Phenix City, AL (US) 36870

( * ) Notice: Subject to any disclaimer, the term of this patent is extended or adjusted under 35 U.S.C. 154(b) by 0 days.

(21) Appl. No.: 09/296,568

(22) Filed: Apr. 22, 1999

(51) Int. Cl.[7] ..... F41A 17/64
(52) U.S. Cl. ..... 42/70.08; 42/1.01
(58) Field of Search ..... 42/70.01, 70.08, 42/70.11, 1.01

(56) References Cited

U.S. PATENT DOCUMENTS 3,888,021 * 6/1975 McCurdy ..... 42/70.08
5,502,915 * 4/1996 Mendelsohn et al. ..... 42/70.11
5,603,179 * 2/1997 Adams ..... 42/70.08
5,915,936 * 6/1999 Brentzel ..... 42/70.11
5,963,844 * 9/1999 Harling et al. ..... 42/70.06
6,098,330 * 8/2000 Schmitt et al. ..... 42/70.11

* cited by examiner

*Primary Examiner*—Stephen M. Johnson
(74) *Attorney, Agent, or Firm*—Alfred F. Hoyte, Jr.

(57) ABSTRACT

A safety device for firearms includes a scanner for scanning in a user's finger or thumb print, and a microprocessor for storing the data associated with the fingerprint. The microprocessor can also be programmed to store the name, address, phone number, and social security number of the user. The device also includes at least two indicator lamps to inform the user whether the system is armed or unarmed, and to provide an indication when the battery is low. A solenoid activated spring loaded mechanism defeats operation of the firing pin thus rendering the firearm inoperable. The mechanism is designed to make the firearm appear to malfunction.

3 Claims, 2 Drawing Sheets

SAFETY DEVICE FOR FIREARMS

BACKGROUND OF THE INVENTION

The present invention relates to a safety mechanism for firearms. More particularly, the invention relates to an electronic system for selectively disabling a firearm.

The use of various devices to increase firearm safety is well known in the art. These mechanisms generally fall into two categories.

Firearm safety mechanisms are generally used to prevent the weapon from firing accidentally due to falling or unintentional operation of the trigger. These mechanisms are generally mounted in the interior of the firearm and are deactivated when the firearm is to be fired. Safety mechanisms suffer from the drawback in that the mechanism can be operated by anyone, including unauthorized individuals or children. Furthermore, many safety mechanisms can be dislodged if the firearm is impacted with sufficient force, sometimes resulting in an unintended and unexpected discharge of the firearm.

The second category of firearm safety device is the gun lock. Gun locks are typically used when the gun is in storage or is being transported. Gun locks are key operated and are usually mounted exteriorly of the firearm. Gun locks suffer from the drawback in that they tend to be very model specific. Gun locks also tend to be very complex thereby resulting in a higher probability of mechanical failure with repeated use. Both gun locks and safety mechanisms suffer from the drawback that if they are exteriorly mounted, they have to be carried around separately resulting in an inconvenience to the user. Another drawback associated with prior devices is that foreign matter can enter the mechanism causing the mechanism to jam rendering the firearm inoperative.

The primary drawback to prior art devices is that they are primarily mechanical devices and can be overcome using relatively simple means. Gun locks requiring keys can be picked, gun locks with combinations require the user to remember the combination. Few of the prior art devices take advantage of recent technological developments, especially electronics, in order to increase firearm safety. One of the prior art devices does take advantage of high tech electronics. These devices include a means for scanning a user's hand, grip pattern, or thumb print, storing it in a memory, and then releasing a locking mechanism when a microprocessors matches the user's hand or thumb print to that stored in memory. While these devices are conceptually sound, they do suffer from drawbacks or inadequacies.

It can first be noted that, as a practical matter, the first generation devices, i.e., those conceived prior to 1988, could not have worked. The size of the processor would not have permitted storage of sufficient data to facilitate the concept. Also, the miniature scanner technology was not known at the time.

Some of the later devices also suffer from problems. U.S. Pat. No. 5,603,179 discloses such a device. The device includes a scanner for scanning in fingerprints, and an associated mechanism for preventing operation of the hammer. First of all, the operation of the device is not clear, but appears to involve the use of a mechanism to physically block the hammer. This type of mechanism may work well with the power applied, but may fail when the power fails. No warning mechanism of any type is available to alert the user that power failure is imminent. Also, if the user applies sufficient force to overcome the locking mechanism, the gun will still fire. It will be apparent to the user that the locking mechanism causes hammer movement to be defeated, since the hammer will not cock. Thus the user will know exactly how to overcome the safety mechanism.

U.S. Pat. No. 4,970,819 discloses a firearm safety system which recognizes the grip pattern of a user, and deactivates a locking mechanism when a match is detected. The system suffers from the drawback in that grip patterns are not sufficiently unique and thus the firearm may be used by someone, other than the authorized user, who has a grip pattern simiilar to that of the authorized user. Also, as in the previous invention, the trigger cannot be actuated, thus making it apparent to the user that some type of locking mechanism is in place.

SUMMARY OF THE INVENTION

It is a major object of this invention to provide a safety device for a firearm which uses a microprocessor controlled locking mechanism.

It is another object of this invention to provide a safety device for firearms which is an integral part of the firearm and includes a fingerprint scanner for scanning and storing the fingerprint of a user.

It is yet another object of this invention to provide a safety device for a firearm which is primarily mounted within the interior of the firearm.

It is another object of this invention to provide a safety device which operates to defeat operation of the firearm when the fingerprint of the user does not match the stored fingerprint.

It is another object of this invention to provide a safety device for a firearm which does not contribute to jamming, or other unintended malfunction of the firing mechanism.

It is another object of this invention to provide a safety device which appears to cause the firearm to malfunction without making it apparent that a locking mechanism is in place.

It is another object of this invention to provide a battery operated safety device for firearms including a low battery warning mechanism.

It is yet another object of this invention to provide a safety device for firearms which can be adapted for use with different types and brands of firearms.

In accordance with the objects of this invention a safety device for firearms is provided. The device includes a scanner for scanning in a user's finger or thumb print, and a microprocessor for storing the data associated with the fingerprint. The microprocessor can also be programmed to store the name, address, phone number, and social security number of the user. The device also includes at least two indicator lamps to inform the user whether the system is armed or unarmed, and to provide an indication when the battery is low. A solenoid activated spring loaded mechanism defeats operation of the firing pin thus rendering the firearm inoperable. The mechanism is designed to make the firearm appear to malfunction.

DETAILED DESCRIPTION OF THE INVENTION

Figure 1:
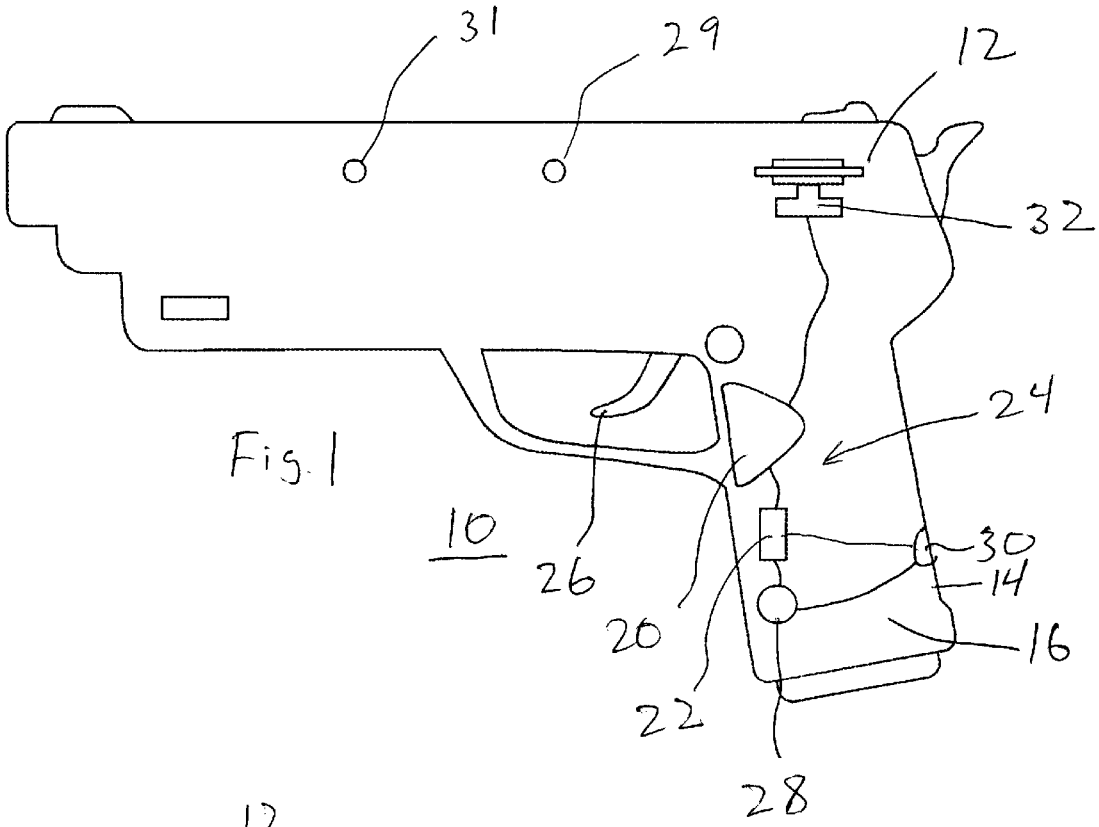
FIG. 1 shows a partially broken away side view of a firearm with the device of the present invention installed.
Figure 2:
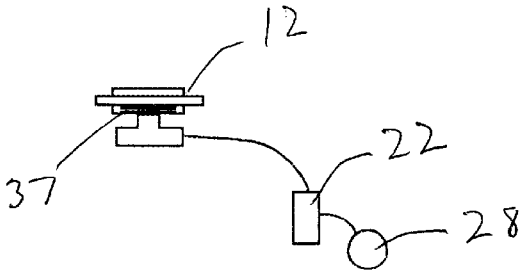
FIG. 2 shows a plan view of the device separate from the firearm.

Referring now to FIGS. 1–3 the device of the present invention, generally indicated by the numeral 10, is shown. The device 10 is essentially a disabling mechanism for a firearm 14 which operates by holding the firing pin 12 out of position to prevent firing of the firearm 14. In the embodiment of FIG. 1, the device is shown mounted on a handle 16 operable to be gripped by a user's hand. The device 10 is shown mounted in an automatic pistol, it can be appreciated by those skilled in the art that slight modifications might be required depending on the make and model of the firearm.

The device consists of three primary components; a scanner element 20 for scanning in the user's finger or thumb print, a microchip or microprocessor 22 for storing the user's finger or thumb print, and a spring loaded, solenoid activated, mechanism 24 for rendering the firing pin 12 inoperable. If desired, a tracking device such as Lo-Jack™ may be installed to track the firearm 14 in the event it is lost or stolen.

The scanner element 20 may be a charged coupled device of the type well known in the art. Of course, other scanner elements may be used without departing from the spirit and scope of the invention. The scanner 20 is activated in response to movement of the trigger 26. Alternatively, the scanner 20 may be mounted upon a switch element which, when depressed, activates the scanner 20 which scans the finger or thumb print of the user and begins to send data to the microprocessor 22. In order to save power, the microprocessor 22 may end the scan as soon as a match or non-match is certain. It can be readily appreciated that the scanner 20 and solenoid mechanism 24 will require the most power of all of the system components.

The microprocessor 22 may be any of several well known processors which can hold sufficient data to store data associated with at least two fingerprints. Preferably, the microprocessor 22 can store several fingerprints so that more than one user may operate the firearm 14. The fingerprint data may be stored as a bitmap having sufficient resolution to distinguish between fingerprints. The microprocessor 22 outputs signals to the solenoid mechanism 24 for selective control thereof. The microprocessor 22 may simply act as a switch to pass current from the battery 28. The program for comparing the fingerprints may be stored on ROM in the microprocessor's 22 memory area. In the preferred embodiment, the microprocessor 22 also stores the name, address, and social security number of the owner, as well as the serial number of the firearm 14. The issue date and vendor identification may also be stored in the microprocessor 22.

A port 30 is provided to allow for electronic interface between the microprocessor 22 and an external computer (not shown) which is used to program and reset the microprocessor 22. Accordingly, the port 30 would be connected to both input and output pins (not shown) on the microprocessor 22. The port 30 is adapted for connection to a standard jack (not shown) to facilitate connection to the computer. The port 30 would also include a connector to the battery 28 so that it may be recharged. Alternatively, the battery 28 may be a disposable alkaline battery allowing for maximum charge storage and immediate replacement when a low battery condition is sensed.

Indicator lights 29 and 31 provide an indication of the operational status of the device. Indicator light 29, which may be a green LED, is activated if the system is armed. Indicator light 31, which may be a red LED, is activated if the system is unarmed. A low battery condition may be indicated by both lights 29 and 31 blinking. The lights 29, 31 may also be used to indicate when scanning is completed, or needs to be redone, e.g., by alternate blinking or some other predetermined pattern.

The solenoid mechanism 12 is selectively connected to AC power which is generated by converting battery power. A separate DC-AC converter may be used, or an oscillator may be built into the microprocessor 22. The solenoid mechanism 12 includes a coil (not shown) which is contained within housing 32. The coil is in close proximity to a permanent magnet (not shown) which is connected to a small post 36 which is mounted within housing 32 and can move vertically within housing 32. The post 36 includes a radially extending stopper 39 which serves to limit the upward travel of the post 36. The post 36 and magnet form a plunger arrangement 34 of the type of which is well known in the solenoid actuator art. The post 36 abuts and is biased by spring 37 so that when no power is applied to the plunger arrangement 34, the post 36, is not in position to block movement of the firing pin 12. The spring 37 pulls the post 36 down and out of engagement with the firing pin 12 as shown in FIG. 3*b*. Thus the firearm 14 can be operated when there is no battery power. It should be noted that most prior art safety devices do not allow the weapon to be fired in the event of a power failure. While this may appear to be the safest approach, it actually has several drawbacks. First, once the battery is completely dead, there is no way to know whether the system has shutoff in the armed or disarmed condition. Secondly, in an emergency, even the intended user cannot use the firearm, a potentially extremely dangerous situation, especially for law enforcement professionals. Third, the system may malfunction and, if so, may continue to prevent operation of the firearm 14 even after power is no longer applied.

Figure 3A:
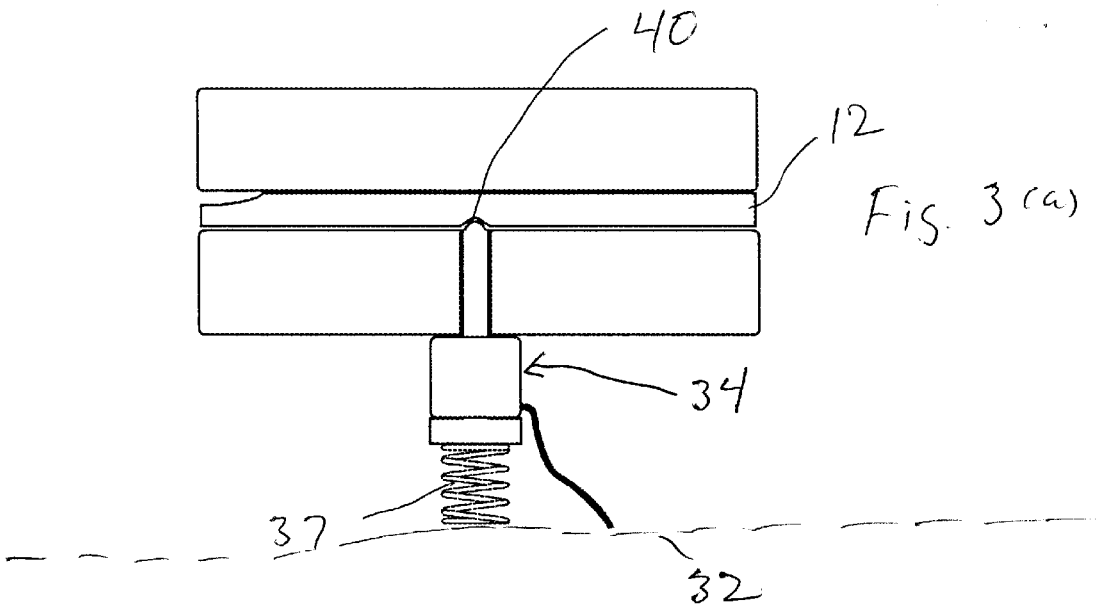
FIG. 3*a* shows a detail of the device shown in FIGS. 1 and 2.
Figure 3B:
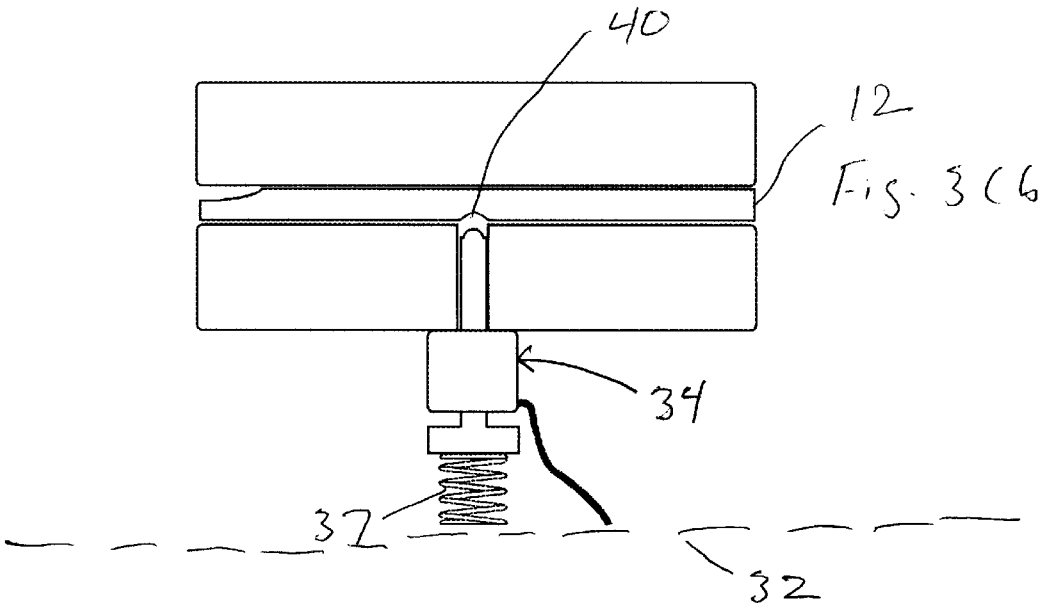
FIG. 3*b* shows a detail of the device shown in FIGS. 1 and 2.

When battery power is applied, and the device 10 is armed, the plunger arrangement 34 pulls the post 36 up and into engagement with a recess 40 sized for secure locking engagement with the post 36 as shown in FIG. 3*a*. Preferably, the recess 40 is relatively shallow to reduce interference with the normal operation of the device. It is well known among gun enthusiasts that jamming can frequently occur with automatic weapons and that a frequent cause of the jamming is the firing pin. Thus, in accordance with the objectives of the present invention, the modifications in and around the firing pin 12 are minimized. It should be noted that the other components of the firing mechanism are deliberately not shown as the position and configuration of these components varies greatly from one manufacturer/model to another. The device 10 of the present invention is designed to disable only the firing pin 12 which has substantially the same configuration regardless of manufacturer/model. It can be readily appreciated that physical orientation and relative dimensions of the device 10 may vary from that shown, but such variance is considered within the spirit and scope of the invention as disclosed and claimed. Of course, it would not be desirable to have the device 10 positioned above the firing pin 12 since gravity will tend to push the post 36 down against the bias of spring 37 and into engagement with the firing pin 12, potentially causing jamming or malfunction. Of course, the spring constant 37 should be made sufficiently strong to avoid this, and such a malfunction would only occur if the spring 37 were dislodged or damaged.

In order to accommodate the device 10 of the present invention, the handle 16 of the firearm may have to be enlarged. Of course, the size of the components is kept to a minimum in order to reduce the extent to which the firearm 14 has to be modified in order to incorporate the device 10. The device 10 may be modified in order to facilitate placement in a rifle or shotgun. Again, model specific modifications may have to be made in order to accommodate the device 10. It should be noted that these modifications are minimized since the firing pin, and not the hammer or trigger or other element, is disabled. Systems which disable the hammer or trigger tend to be even more model specific since the spacing of these components of the firing mechanism varies from weapon to weapon. Also, the firing pin 12 does not have to be moved in order to disable the weapon.

In operation, the user picks up the firearm 14 and places his hand over the scanner 20. Preferably, the scanner 20 is positioned so that a "normal" hand grip will cause activation of the scanner 20. Once the scanner 20 is activated, the finger or thumb print is scanned and compared to the stored finger print or prints in order to determine if the system should remain armed (i.e., if firing should be disabled). Once the microprocessor 22 has confirmed a match, the post 36 is pulled down and out of engagement with the firing pin 12, and the red LED 31 is activated indicating that the firearm 14 may be fired.

In an alternative embodiment, the scanner may continually scan the finger or thumb print of the user and become disable when either there is no finger or thumb print, or a thumb print not previously stored in the microprocessor 22 is detected.

The firearm 14 may be continually fired until the user depresses the safety switch 44, which resets the system, and requires another fingerprint match before the device 10 will allow operation of the firearm 12. Alternatively, the system may time out after a predetermined time which may be stored in the microprocessor 22 ROM, or programmed into the microprocessor 22 RAM and thus be adjustable by the user. Thus, the device 10 operates as "part-time" disabling mechanism which is especially useful in the fields of law enforcement. The device is particularly effective at reducing the incidence of police officers having their guns taken and then used on them. The device 10 is not designed as a long term firearm disabling device, trigger locks and other devices should be used in conjunction with this device for safe storage.

It is to be understood that the provided illustrative examples are by no means exhaustive of the many possible uses for my invention.

From the foregoing description, one skilled in the art can easily ascertain the essential characteristics of this invention and, without departing from the spirit and scope thereof, can make various changes and modifications of the invention to adapt it to various usages and conditions.

It is to be understood that the present invention is not limited to the sole embodiment described above, but encompasses any and all embodiments within the scope of the following claims:

I claim:

1. A firearm incorporating a safety device, said firearm having a firing pin for impacting ammunition which may be loaded into said firearm, the firearm incorporating a safety device comprising:

a scanner capable of scanning a finger or thumb print and generating data representative of said finger or thumb print;

a microprocessor connected to said scanner for receiving said data, said microprocessor having memory means for storing data representative of at least one finger or thumb print and a source of power;

a disabling mechanism proximate to said firing pin, said mechanism having a disabling actuator for selectively moving into and out of engagement with said firing pin thereby selectively enabling and disabling said firing pin in response to a control signal from said microprocessor;

indicator means operatively connected to said microprocessor for indicating whether said firing pin is in the operable or inoperable position;

wherein said disabling mechanism includes a spring loaded solenoid which is biased to maintain said firing pin in an operable position when said source of power is exhausted.

2. The device of claim 1 wherein said indicator means can also provide an indication of the state of said source of power.

3. The device of claim 1 wherein said disabling actuator includes a vertically moving post sized for engagement with a recess formed within said firing pin.

* * * * *